US005585833A

United States Patent [19]

Matumoto

[11] Patent Number: 5,585,833

[45] Date of Patent: Dec. 17, 1996

[54] TONE CONTROL METHOD FOR THERMAL TRANSFER TYPE COLOR PRINTER

[75] Inventor: Tomohiko Matumoto, Kanagawa-ken, Japan

[73] Assignee: Victor Company of Japan, Ltd., Yokohama, Japan

[21] Appl. No.: 373,645

[22] Filed: Jan. 17, 1995

[30] Foreign Application Priority Data

Jan. 18, 1994 [JP] Japan ..... 6-017884

[51] Int. Cl.[6] ..... B41J 2/36

[52] U.S. Cl. ..... 347/183; 358/298

[58] Field of Search ..... 347/183, 211, 347/172; 400/120.07; 358/298

[56] References Cited

U.S. PATENT DOCUMENTS 4,691,211 9/1987 Brownstein ..... 347/183

FOREIGN PATENT DOCUMENTS 61-176273 8/1986 Japan .
62-15971 1/1987 Japan .
2-182469 7/1990 Japan .

*Primary Examiner*—Huan H. Tran
*Attorney, Agent, or Firm*—Michael N. Meller

[57] ABSTRACT

For tone control of a thermal transfer type color printer, an image data of red (R), green (G) and blue (B) is converted by a color conversion circuit into an image data of yellow (Y), magenta (M) and cyan (C). The respective 8-bit Y, M and C image data from the color conversion circuit are converted to 12-bit image data by a look-up table. A converter circuit divides 256 tone levels represented by the upper 8 bits of the 12-bit image data as an integer portion and the lower 4 bits thereof as a decimal portion to a first region whose tone level is equal to or lower than a predetermined tone level and a second region whose tone level is equal to or higher than the predetermined tone level. In the first region, a multilevel area tone is performed by using all of the 12 bits with a plurality of dots in both a main scan direction and a sub-scan direction as one block and, in the second region tone, a multivalue area tone using only the lower 4 bits and usual density tone using the remaining dots are used in combination. With this scheme, it is possible to realize a thermal transfer color printer which can improve S/N ratio in low tone and improve the color reproducibility.

4 Claims, 7 Drawing Sheets

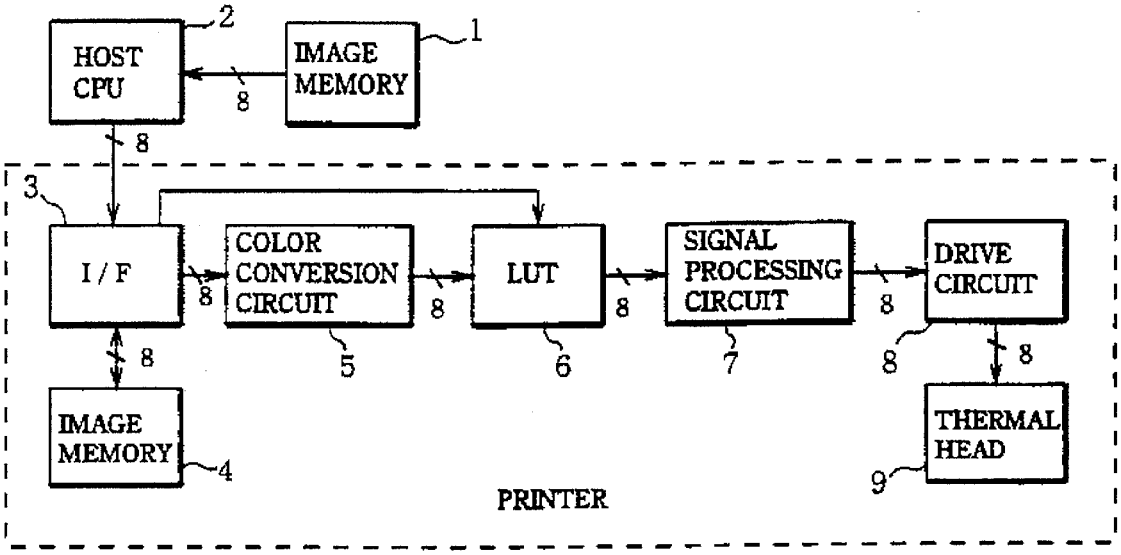
FIG. 1
PRIOR ART
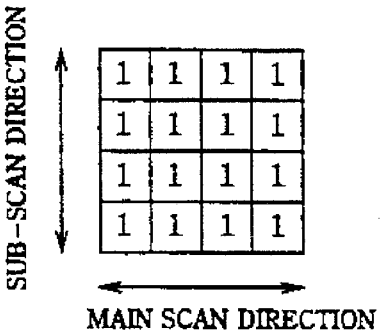
| | | | |
|---|---|---|---|
| 1 | 1 | 1 | 1 |
| 1 | 1 | 1 | 1 |
| 1 | 1 | 1 | 1 |
| 1 | 1 | 1 | 1 |
TONE 1
FIG. 2A
PRIOR ART
| | | | |
|---|---|---|---|
| 10 | 10 | 10 | 10 |
| 10 | 10 | 10 | 10 |
| 10 | 10 | 10 | 10 |
| 10 | 10 | 10 | 10 |
TONE 10
FIG. 2B
PRIOR ART

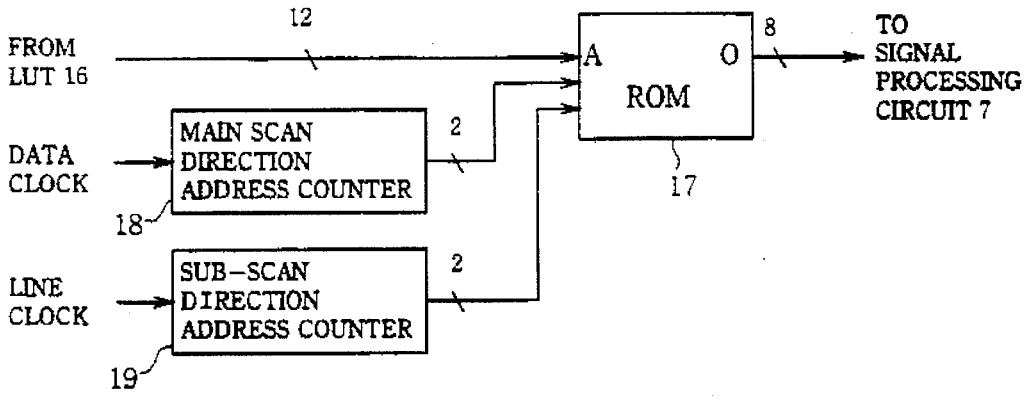
FIG. 5
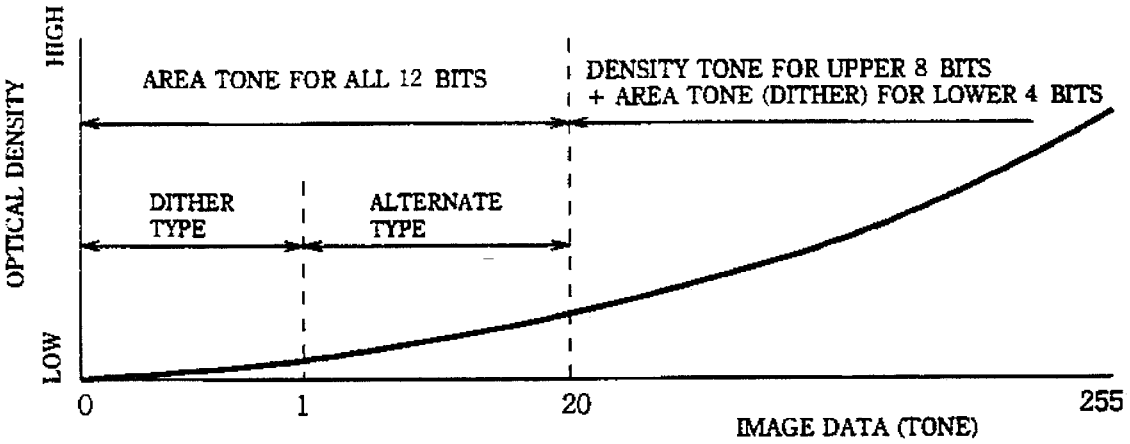
FIG. 6
| | | | |
|---|---|---|---|
| D | 6 | 7 | E |
| 5 | 2 | 0 | 8 |
| 4 | 1 | 3 | 9 |
| C | B | A | F |
DITHER TYPE
FIG. 7A
| | | | |
|---|---|---|---|
| A | B | A | B |
| B | A | B | A |
| A | B | A | B |
| B | A | B | A |
ZIGZAG (ALTERNATE) TYPE
FIG. 7B
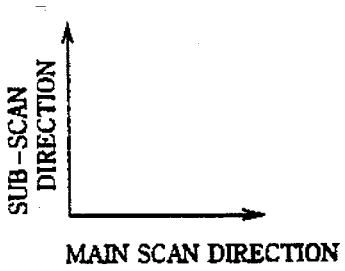
FIG. 7C 0.0625

| | | | |
|---|---|---|---|
| 0 | 0 | 0 | 0 |
| 0 | 0 | 1 | 0 |
| 0 | 0 | 0 | 0 |
| 0 | 0 | 0 | 0 |

0.125

| | | | |
|---|---|---|---|
| 0 | 0 | 0 | 0 |
| 0 | 0 | 1 | 0 |
| 0 | 1 | 0 | 0 |
| 0 | 0 | 0 | 0 |

0.1875

| | | | |
|---|---|---|---|
| 0 | 0 | 0 | 0 |
| 0 | 1 | 1 | 0 |
| 0 | 1 | 0 | 0 |
| 0 | 0 | 0 | 0 |

0.25

| | | | |
|---|---|---|---|
| 0 | 0 | 0 | 0 |
| 0 | 1 | 1 | 0 |
| 0 | 1 | 1 | 0 |
| 0 | 0 | 0 | 0 |

0.3125

| | | | |
|---|---|---|---|
| 0 | 0 | 0 | 0 |
| 0 | 1 | 1 | 0 |
| 1 | 1 | 1 | 0 |
| 0 | 0 | 0 | 0 |

0.375

| | | | |
|---|---|---|---|
| 0 | 0 | 0 | 0 |
| 1 | 1 | 1 | 0 |
| 1 | 1 | 1 | 0 |
| 0 | 0 | 0 | 0 |

0.4375

| | | | |
|---|---|---|---|
| 0 | 1 | 0 | 0 |
| 1 | 1 | 1 | 0 |
| 1 | 1 | 1 | 0 |
| 0 | 0 | 0 | 0 |

0.5

| | | | |
|---|---|---|---|
| 0 | 1 | 1 | 0 |
| 1 | 1 | 1 | 0 |
| 1 | 1 | 1 | 0 |
| 0 | 0 | 0 | 0 |

0.5625

| | | | |
|---|---|---|---|
| 0 | 1 | 1 | 0 |
| 1 | 1 | 1 | 1 |
| 1 | 1 | 1 | 0 |
| 0 | 0 | 0 | 0 |

0.625

| | | | |
|---|---|---|---|
| 0 | 1 | 1 | 0 |
| 1 | 1 | 1 | 1 |
| 1 | 1 | 1 | 1 |
| 0 | 0 | 0 | 0 |

0.687

| | | | |
|---|---|---|---|
| 0 | 1 | 1 | 0 |
| 1 | 1 | 1 | 1 |
| 1 | 1 | 1 | 1 |
| 0 | 0 | 1 | 0 |

0.75

| | | | |
|---|---|---|---|
| 0 | 1 | 1 | 0 |
| 1 | 1 | 1 | 1 |
| 1 | 1 | 1 | 1 |
| 0 | 1 | 1 | 0 |

0.8125

| | | | |
|---|---|---|---|
| 0 | 1 | 1 | 0 |
| 1 | 1 | 1 | 1 |
| 1 | 1 | 1 | 1 |
| 1 | 1 | 1 | 0 |

0.875

| | | | |
|---|---|---|---|
| 1 | 1 | 1 | 0 |
| 1 | 1 | 1 | 1 |
| 1 | 1 | 1 | 1 |
| 1 | 1 | 1 | 0 |

0.9375

| | | | |
|---|---|---|---|
| 1 | 1 | 1 | 1 |
| 1 | 1 | 1 | 1 |
| 1 | 1 | 1 | 1 |
| 1 | 1 | 1 | 0 |

1.0

| | | | |
|---|---|---|---|
| 1 | 1 | 1 | 1 |
| 1 | 1 | 1 | 1 |
| 1 | 1 | 1 | 1 |
| 1 | 1 | 1 | 1 |

*FIG. 8*

1. 5

| | | | |
|---|---|---|---|
| 1 | 2 | 1 | 2 |
| 2 | 1 | 2 | 1 |
| 1 | 2 | 1 | 2 |
| 2 | 1 | 2 | 1 |

2. 0

| | | | |
|---|---|---|---|
| 1 | 3 | 1 | 3 |
| 3 | 1 | 3 | 1 |
| 1 | 3 | 1 | 3 |
| 3 | 1 | 3 | 1 |

2. 5

| | | | |
|---|---|---|---|
| 1 | 4 | 1 | 4 |
| 4 | 1 | 4 | 1 |
| 1 | 4 | 1 | 4 |
| 4 | 1 | 4 | 1 |

3. 0

| | | | |
|---|---|---|---|
| 1 | 5 | 1 | 5 |
| 5 | 1 | 5 | 1 |
| 1 | 5 | 1 | 5 |
| 5 | 1 | 5 | 1 |

- -

10. 0

| | | | |
|---|---|---|---|
| 1 | 19 | 1 | 19 |
| 19 | 1 | 19 | 1 |
| 1 | 19 | 1 | 19 |
| 19 | 1 | 19 | 1 |

10. 5

| | | | |
|---|---|---|---|
| 1 | 20 | 1 | 20 |
| 20 | 1 | 20 | 1 |
| 1 | 20 | 1 | 20 |
| 20 | 1 | 20 | 1 |

11. 0

| | | | |
|---|---|---|---|
| 2 | 20 | 2 | 20 |
| 20 | 2 | 20 | 2 |
| 2 | 20 | 2 | 20 |
| 20 | 2 | 20 | 2 |

11. 5

| | | | |
|---|---|---|---|
| 3 | 20 | 3 | 20 |
| 20 | 3 | 20 | 3 |
| 3 | 20 | 3 | 20 |
| 20 | 3 | 20 | 3 |

- -

13. 0

| | | | |
|---|---|---|---|
| 8 | 22 | 8 | 22 |
| 22 | 8 | 22 | 8 |
| 8 | 22 | 8 | 22 |
| 22 | 8 | 22 | 8 |

14. 5

| | | | |
|---|---|---|---|
| 9 | 20 | 9 | 20 |
| 20 | 9 | 20 | 9 |
| 9 | 20 | 9 | 20 |
| 20 | 9 | 20 | 9 |

15. 0

| | | | |
|---|---|---|---|
| 10 | 20 | 10 | 20 |
| 20 | 10 | 20 | 10 |
| 10 | 20 | 10 | 20 |
| 20 | 10 | 20 | 10 |

15. 5

| | | | |
|---|---|---|---|
| 11 | 20 | 11 | 20 |
| 20 | 11 | 20 | 11 |
| 11 | 20 | 11 | 20 |
| 20 | 11 | 20 | 11 |

- -

- - - - -

19. 0

| | | | |
|---|---|---|---|
| 18 | 20 | 18 | 20 |
| 20 | 18 | 20 | 18 |
| 18 | 20 | 18 | 20 |
| 20 | 18 | 20 | 18 |

19. 5

| | | | |
|---|---|---|---|
| 19 | 20 | 19 | 20 |
| 20 | 19 | 20 | 19 |
| 19 | 20 | 19 | 20 |
| 20 | 19 | 20 | 19 |

20. 0

| | | | |
|---|---|---|---|
| 20 | 20 | 20 | 20 |
| 20 | 20 | 20 | 20 |
| 20 | 20 | 20 | 20 |
| 20 | 20 | 20 | 20 |

*FIG. 9*

TONE CONTROL METHOD FOR THERMAL TRANSFER TYPE COLOR PRINTER

BACKGROUND OF THE INVENTION

1. Field of the Invention

The present invention relates to a tone control method for a thermal transfer type color printer such as a color printer of thermal sublimation or thermal solution type.

2. Description of the Prior Art

Thermal transfer color printers using thermally sublimating or soluble ink has been used conventionally. The thermal color printer of thermal sublimation type can print an image with very high quality in as large a number of tones as, for example, 256 tones. On the other hand, a recently developed thermal color printer of thermal solution type can print an image with, for example, 16 tones, although in the past it could print an image with only two tones, 1 and 0. Therefore, the thermal sublimation type color printer is conventionally used when multitone, high-image quality is desired. The thermal solution type color printer is used when cost is important since it is cheaper.

FIG. 1 is a block diagram showing the construction of a conventional thermal transfer type color printer schematically, with reference to which a conventional tone control method will be described. The printer shown in FIG. 1 is of the thermal sublimation type.

In FIG. 1, an image picked up by a scanner or a camera (not shown) is stored in an image memory 1. An image data of, for example, 8 bits (256 tones) output from the image memory 1 is input to an interface circuit (I/F) 3 of the printer through a host CPU 2. The image data supplied to the interface circuit 3 is stored on demand in an image memory 4. When externally supplied image data is to be directly printed, the image memory 4 may be eliminated. In this description, it is assumed that the image data is temporarily stored in the image memory 4. The image data readout from the image memory 4 is supplied to a color conversion circuit 5 through the interface circuit 3. The color conversion circuit 5 converts image data of R (red), G (green) and B (blue) into data of Y (yellow), M (magenta) and C (cyan).

The Y, M and C image data output from the color conversion circuit 5 is input to a look-up table (LUT) 6. The LUT 6 is also supplied with data for color regulation prepared by the host CPU 2 through the interface circuit 3 and finely regulates colors of the image data by performing gamma correction, etc., according to the color regulation data. The LUT 6 has a random access memory (RAM) and outputs an 8-bit input data as an 8-bit output data.

The image data output from the LUT 6 is input to a signal processing circuit 7 in which it is subjected to various corrections including correction due to heat accumulation, etc. The image data output from the signal processing circuit 7 is input to a drive circuit 8 for driving a thermal head 9. The thermal head 9 is driven by the drive circuit 8 according to the image data, resulting in an image print.

In this case, when the image data has tone level 1, respective dots thereof are tone level 1 as shown in FIG. 2(A). When the image data has tone level 10, the respective dots thereof are tone level 10 as shown in FIG. 2(B). A matrix shown in these figures includes 16 pixels, 4 dots in a main scan direction×4 dots in a sub-scan direction. The tone of the image is provided by controlling optical density of the image in this manner.

With a thermal transfer color printer of the thermal solution type, an image data does not require 8 bits. Therefore, the image data output from the signal processing circuit 7 may be made 4 bits (16 tone levels) for tone expression.

Since, therefore, the thermal sublimation type color printer differs from the thermal solution type color printer in only the number of tone levels, the tone control method will be described mainly for the thermal transfer type color printer having 256 tone levels (8 bits).

When color is regulated in a thermal transfer type color printer capable of printing an image with optical density in 256 tone levels (8 bits), the optical density of the image may become larger by one step due to a slight lack of, for example, the cyan component. There may be a case in which the cyan density becomes too large. That is, very strict color regulation in a thermal transfer type color printer having 256 tone levels is to some extent limited.

This problem may be solved easily by using image data of 12 bits so that a tone range to be printed is expanded to 4,096 tones. However, the cost of the image memory 4 is substantially increased with increase of the memory capacity. Also, the cost of the color conversion circuit 5 and the signal processing circuit 7 is correspondingly increased. In addition to the cost problem, there is the technical problem that a very precise thermal control of the thermal head 9 is necessary. Therefore, it is not practical to increase the number of bits of the image data to 12.

In the thermal sublimation type of color transfer printer, particularly, the start of coloring is unstable due to the influence of environmental temperature, etc. Also, the S/N ratio in low optical density (low tone levels) is degraded due to the influence of the surface condition of a sheet on which an image is transferred.

BRIEF SUMMARY OF THE INVENTION

A first object of the present invention is to provide a tone control method for a thermal transfer type color printer, which improves S/N ratio in low tone levels and substantially improves color reproducibility without substantial increase of cost.

A second object of the present invention is to provide a tone control method for a thermal transfer type color printer for printing an image data output from a look-up table for color regulation of an input image data by means of a thermal head. The method includes the steps of dividing tones represented by the image data output from the look-up table into a first region equal to or lower than a predetermined threshold value and into a second region equal to or higher than the threshold value. The tones are controlled in the first region by using a multilevel area tone utilizing all bits of the image data with a plurality of dots in a main scan direction and a sub-scan direction being a unit block. The tones are controlled in the second region by using a multilevel area tone utilizing only lower one bit or a plurality of bits of the image data together with an optical density tone of the remaining bits with the plurality of dots being a unit block. An image is printed through the thermal head according to the image data whose tone is controlled by the controlling steps and whose number of bits is smaller than the number of bits of the image data output from the look-up table.

A third object of the present invention is to provide the tone control method of the second object, wherein the number of the lower one bit or a plurality of bits of the image data is the number of bits of the image data output from the look-up table subtracted by the number of bits of the image data input to the thermal head.

A fourth object of the present invention is to provide the tone control method of the second object, wherein the first region is further subdivided into two subregions having lower tone levels and higher tone levels and an area tone pattern of the subregion having lower tone levels is different from that of the subregion having higher tone levels.

A fifth object of the present invention is to provide the tone control method of the third object, wherein the first region is further subdivided into two subregions having lower tone levels and higher tone levels and an area tone pattern of the subregion having lower tone levels is different from that of the subregion having higher tone levels.

BRIEF DESCRIPTION OF THE DRAWINGS

FIG. 1 is a block diagram of a construction for realizing a conventional tone control method of a thermal transfer type color printer;

FIG. 2 shows an example of a pattern in the conventional tone control method of the thermal transfer type color printer;

FIG. 5 is a block diagram of the conversion circuit 17 in FIG. 3;

FIG. 6 is a graph for explaining pattern switching in the tone control method of the thermal transfer type color printer, according to the first embodiment;

FIG. 7 is an explanatory drawing of an optical density pattern in the tone control method of the thermal transfer type color printer, according to the first embodiment;

FIG. 8 shows an example of the optical density pattern in the tone control method of the thermal transfer type color printer, according to the first embodiment;

FIG. 9 shows another example of the optical density pattern in the tone control method of the thermal transfer type color printer, according to the first embodiment;

DETAILED DESCRIPTION OF THE INVENTION

Figure 3:
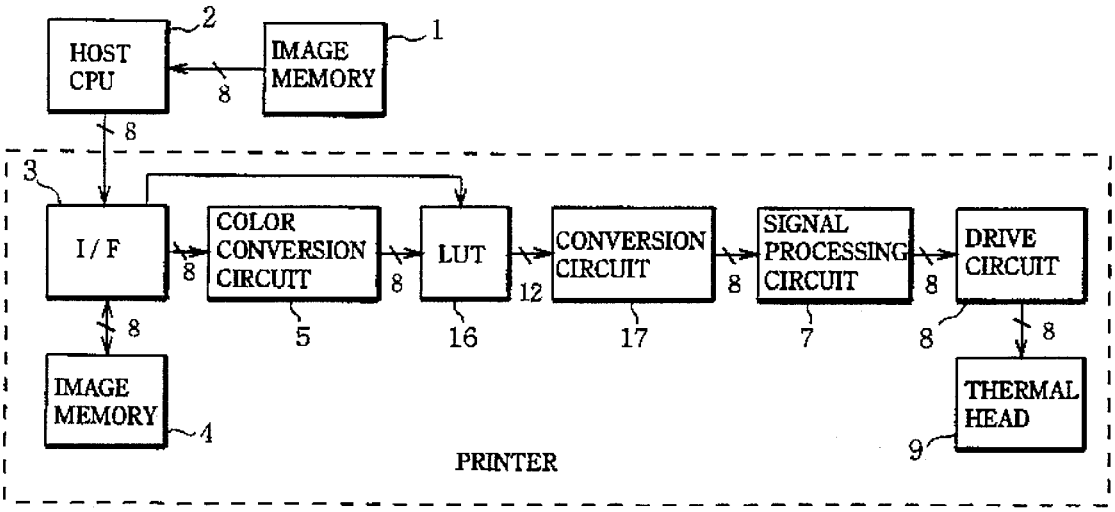
FIG. 3 is a block diagram of a first embodiment of the present invention of a construction for realizing a tone control method of a thermal transfer type color printer.

FIG. 3 is a block diagram of an embodiment of a construction for realizing a tone control method of a thermal transfer type color printer, according to a first embodiment of the present invention. In FIG. 3, an image picked up by a scanner or a camera (not shown) is stored in an image memory 1 as an image data. An image data of, for example, 8 bits (256 tones) output from the image memory 1 is input to an interface circuit 3 of the printer through a host CPU 2. The image data supplied to the interface circuit 3 is stored on demand in an image memory 4.

When an externally supplied image data is to be directly printed, the image memory 4 may be eliminated. In this description, it is assumed that the image data is temporarily stored in the image memory 4. The image data readout from the image memory 4 is supplied to a color conversion circuit 5 through the interface circuit 3. The color conversion circuit 5 converts image data of R (red), G (green) and B (blue) into data of Y (yellow), M (magenta) and C (cyan).

The Y, M and C image data output from the color conversion circuit 5 is input to a look-up table (LUT) 16. The LUT 16 is also supplied with data for color regulation prepared by the host CPU 2 through the interface circuit 3 and finely regulates colors of the image data (performs the gamma correction, etc.) according to the color regulation data.

Figure 4:
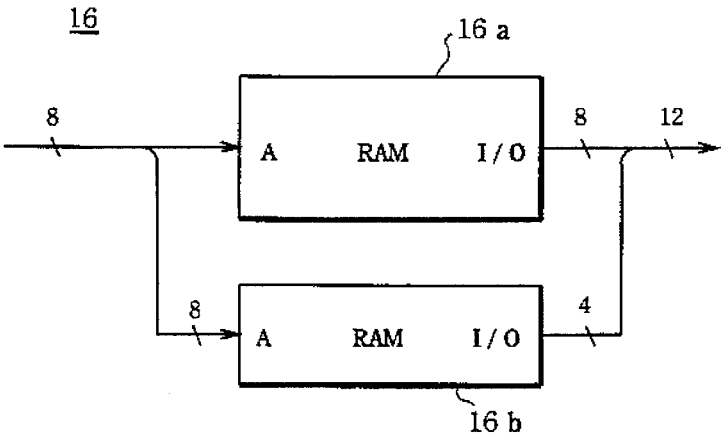
FIG. 4 is a block diagram of the look-up table 16 in FIG. 3.

In order to perform a fine color regulation, the LUT 16 outputs the input 8-bit image data as a 12-bit image data. The LUT 16 has a conventional 8-bit input/8-bit output random access memory (RAM) **16*a* corresponding to the LUT 6 shown in FIG. 1, and an 8-bit input/4-bit output RAM 16*b* connected in parallel to the 8-bit input/8-bit output RAM 16*a*, as shown in FIG. 4. It is of course possible to constitute the LUT 16** with a single 8-bit input/12-bit output RAM.

The 12-bit image data output from the LUT 16 is input to a converter circuit 17 which converts the 12-bit data into an 8-bit data. The converter circuit 17 includes a read-only memory (ROM) as shown in FIG. 5. A main scan direction address counter 18 and a sub-scan direction address counter 19, shown in FIG. 5, are usually provided in a signal processing circuit 7 and, therefore, there is no need for providing them separately.

As will be described, the first embodiment of the present invention is featured by using a multilevel area tone control (tone control using a multilevel dot matrix) and changing the matrix pattern according to tone.

The bits of the 12-bit input image data input to the converter circuit 17 is divided into upper 8 bits and lower 4 bits. The upper 8 bits correspond to an integer and the lower 4 bits correspond to a decimal number. FIG. 6 shows the relation between the input data and the optical density (OD) thereof. In this embodiment, 256 tone levels 0 to 255 represented by the upper 8 bits, are divided into a first region whose tone level is equal to or lower than tone level 20, which is a predetermined threshold level, and into a second region whose tone level is equal to or higher than the tone level 20. In the first region, having a tone level equal to or lower than the tone level 20, an image is represented as a multilevel area tone using all 12 bits. In the second region, having a tone level equal to or higher than tone level 20, an image is represented by using the upper 8 bits of the total 12 bits as the usual density tone and the lower 4 bits, which is a decimal number, as the multilevel area tone. The tone control, by means of density tone, means a tone control using variable dots in which tone is controlled as a dot unit according to the size of dot to be actually printed. Although resolution is degraded when the area tone is used, an effective resolution of image is never degraded since human eyes do not require high resolution for low optical density.

Preferably, in this embodiment, an area tone pattern used for tone levels 0 to 1 is different from that for tone levels 1 to 20. That is, for tone levels 0 to 1, a dither type area tone is used and, for tone levels 1 to 20, a zigzag type (alternate type) area tone is used. It should be noted that the range of tone levels 0 to 1 cannot be represented by the conventional 8-bit method.

The tone dependent pattern will be described further. As shown in FIG. 7, an area defined by 4 dots in the main scan direction and 4 dots in the sub-scan direction is considered as a block. In the first region of tone levels, 0 to 1, a tone control is performed by using a dither type area tone, as an example. FIG. 7(A) shows an example of the dither type area tone, in which 16 patterns, each formed by forming dots of tone level 1 in a sequence of 0, 1, 2, . . . D, E, F, are used. That is, as shown in FIG. 8, sixteen matrix patterns corresponding to 16 tone levels represented by the lower 4 bits of the total of 12 bits are set. Then, one of the 16 matrix patterns which corresponds to the tone level of dots to be printed is selected and the dot value corresponding to the dot to be printed is derived from the selected matrix pattern.

For tone levels 1 to 20 in the first region, the tone control is performed by using the zigzag type (alternate type) area tone. For example, a pattern shown in FIG. 7(B) is used.

That is, for a sum of the integer represented by the upper 8 bits and the decimal number represented by the lower 4 bits, which is within a range from 1 to 20, matrix patterns are set in steps of 0.5 as shown in FIG. 9. One of these matrix patterns which corresponds to a value of the dot to be printed is selected and a dot value corresponding to the dot to be printed is selected from the selected matrix pattern. When the tone value of the dot to be printed is within the step of 0.5, a matrix pattern whose value is closest to the tone value is used.

Figure 10:
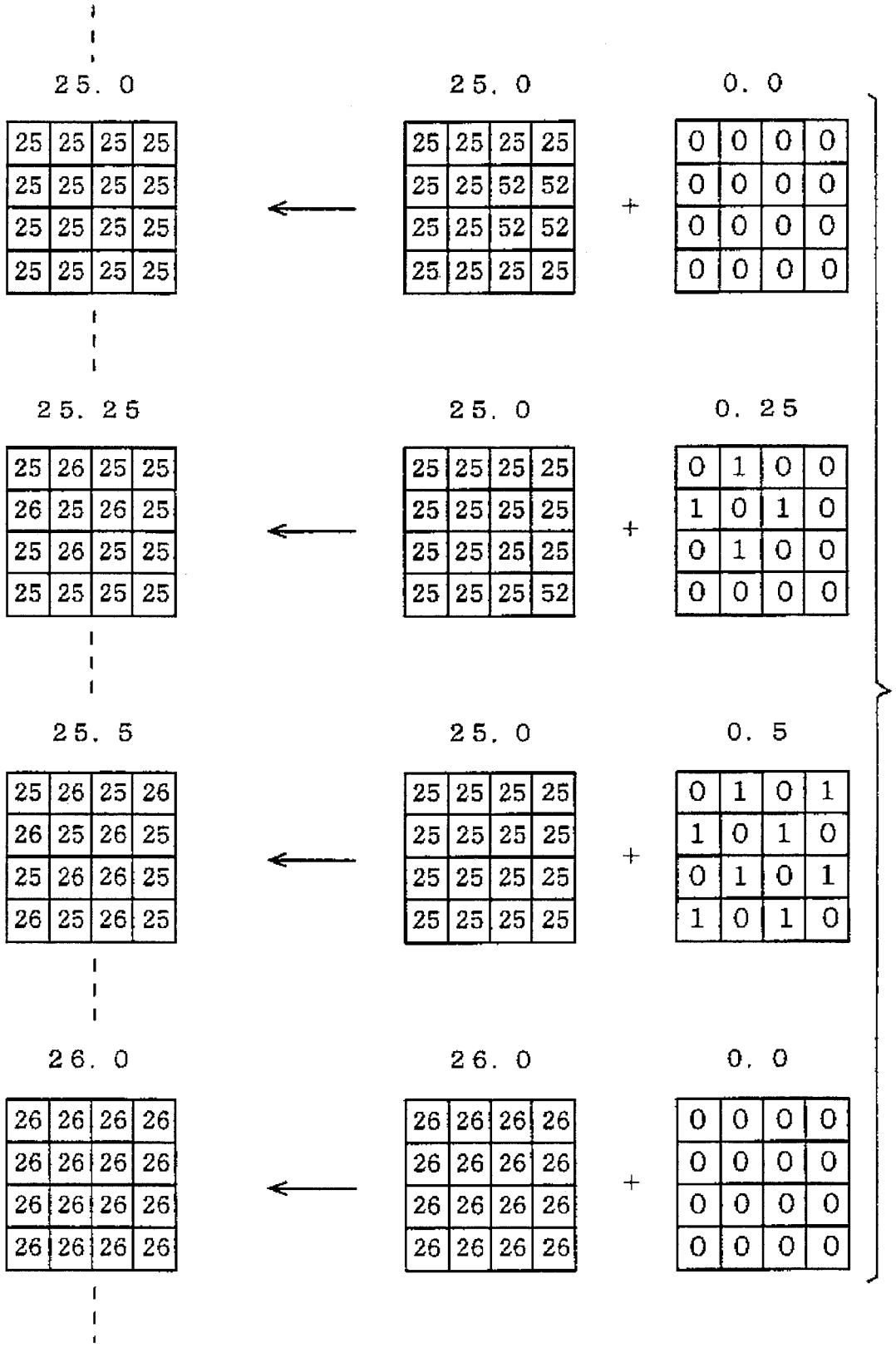
FIG. 10 shows a further example of the optical density pattern in the tone control method of the thermal transfer type color printer, according to the first embodiment.

Further, in the second region, sixteen matrix patterns are combined, as shown in FIG. 10, such that the tone control is performed with optical density corresponding to the value of the integer component of the upper 8 bits and the area tone control of the dither type is performed for the decimal component of the lower 4 bits. In the second region, the dither type area tone having patterns different from that shown in FIG. 7(A) is used. However, it is possible to use the same pattern as that shown in FIG. 7(A) for the case of the first region.

Although, in this embodiment, the threshold value separating the first region from the second region is set as tone value 20 (about 0.2 OD), the threshold value is not limited to this value. It can be any value provided that it is a value slightly smaller than a value at which degradation of resolution due to the use of area tone becomes visually highlighted and is most effective in improving S/N ratio. Further, although the first region is preferably subdivided into the first subregion including tones 0 to 1 and the second subregion including tones 1 to 20, it is possible to use the dither type area tone for the entire first region. Also, the subdivision can be made at a tone value other than 1.

Further, in respective threshold values, the pattern of tone 1 represented by using the dither type area tone is completely the same as that represented by using the zigzag type (alternate type) area tone. The pattern of tone (20) represented by using the zigzag (alternate) type area tone is completely the same as that represented by using the area tone for only decimal 4 bits. Therefore there is no step (joint) generated in a border between patterns.

Such pattern for each tone of the input image data is preliminarily set in the ROM constituting the converter circuit 17. In this case, addresses in the main scan direction and the sub-scan direction in one block are determined by 2-bit data output from the main scan direction address counter 18 and the sub-scan address counter 19 (see FIG. 5).

As shown in FIG. 3, the 8-bit data output from the converter circuit 17 is input to the signal processing circuit 7 in which various corrections including heat accumulation correction, etc. are performed on the data. The image data from the signal processing circuit 7 is supplied to a drive circuit 8 for driving a thermal head 9. The thermal head 9 is driven by the drive circuit 8 according to the image data, resulting in an image.

The embodiment which uses the LUT 16 which outputs the 8-bit data as 12-bit data has been described. This is to perform a finer color regulation by using bits larger in number than that of the image data actually input to the thermal head 9.

In the case of the thermal solution type color printer, when the number of bits of an image data input to the thermal head 9 is 4, the number of bits of the image data input to the thermal head 9 is smaller than that of the image data input to the look-up table. Therefore, the conventional 8-bit input/8-bit output LUT 6 can be used instead of the 8-bit input/12-bit output LUT 16.

Figure 11:
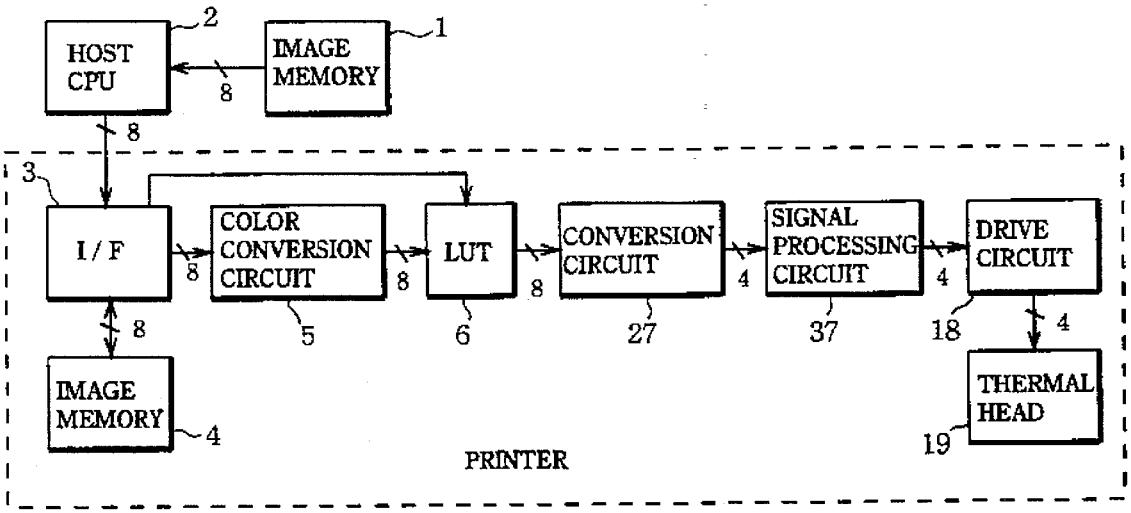
FIG. 11 is a block diagram of a second embodiment of the present invention of a construction for realizing a tone control method of a thermal transfer type color printer.

In such case, as shown in FIG. 11, the converter circuit 27 may be a ROM for converting 8-bit data into 4-bit data and its pattern is changed according to tone by using the multivalue area tone in the same manner as that for the 12-bit data mentioned above. That is, the tone value represented by the bit number of the image data output from the LUT 6 is divided into a first region and a second region. In the first region, the multivalue area tone is utilized by using all of the 8 bits of the image data for an area defined by a plurality of dots in the main scan and sub-scan directions as a block. In the second region, the combination of the multivalue area tone is utilized by using only the lower one or a plurality of bits of the image data, the number of which is preferably 8–4=4 bits, and the optical density tone by the remaining bits. Thus, it becomes possible to represent tones larger in number than the actual bits and to improve the image quality of the transferred image, even in the thermal solution type transfer color printer.

What is claimed is:

1. A tone control method for a thermal transfer color printer for printing an image data output from a look-up table for color regulation of an input image data having a plurality of bits by means of a thermal head, the method comprising the steps of:

dividing tones represented by said image data output from said look-up table into a first region equal to or lower than a predetermined threshold value and into a second region equal to or higher than said threshold value;

controlling tones, made up of a plurality of dots, in said first region by using a multilevel area tone utilizing all bits of said image data, with a plurality of dots in a main scan direction and a sub-scan direction being a unit block;

controlling tones, made up of a plurality of dots, in said second region by using a multilevel area tone utilizing only the lower one bit or a plurality of bits of said image data together with an optical density tone of the remaining bits with the plurality of dots being a unit block; and printing an image through said thermal head according to the image data whose tone is controlled by the controlling steps and wherein the number of bits input to said thermal head is smaller than the number of bits of the image data output from the look-up table.

2. The tone control method claimed in claim 1, wherein the number of the lower one bit or the plurality of bits of said image data is the number of bits of said image data output from said look-up table minus the number of bits of the image data input to the thermal head.

3. The tone control method claimed in claim 1, wherein said first region is further subdivided into first and second subregions, said first sub-region having lower tone levels and said second subregion having higher tone levels and an area tone pattern of said first subregion is different from that of said second subregion.

4. The tone control method claimed in claim 2, wherein said first region is further subdivided into first and second subregions, said first subregion having lower tone levels and said second subregion having higher tone levels and an area tone pattern of said first subregion is different from that of said second subregion.

* * * * *